United States Patent [19]

Salomon

[11] 4,405,153

[45] Sep. 20, 1983

[54] SAFETY BINDING FOR SKI

[75] Inventor: Georges P. J. Salomon, Annecy, France

[73] Assignee: Etablissements Francois Salomon & Fils, Annecy, France

[21] Appl. No.: 245,460

[22] Filed: Mar. 19, 1981

[30] Foreign Application Priority Data

Mar. 21, 1980 [FR] France ..... 80 06365

[51] Int. Cl.[3] ..... A63C 9/085

[52] U.S. Cl. ..... 280/629; 280/634

[58] Field of Search ..... 280/629, 626, 628, 618, 280/634

[56] References Cited

U.S. PATENT DOCUMENTS 4,260,175 4/1981 Salomon ..... 280/629

4,302,027 11/1981 Himmetsberger ..... 280/629

FOREIGN PATENT DOCUMENTS 2020954 11/1971 Fed. Rep. of Germany ..... 280/629

7808342 3/1978 France .

7837119 12/1978 France .

7914484 6/1979 France .

*Primary Examiner*—David M. Mitchell

*Assistant Examiner*—Timothy Roesch

*Attorney, Agent, or Firm*—Sandler & Greenblum

[57] ABSTRACT

A safety binding for a ski including a body having a jaw for holding a ski boot and a support fixed to the ski. The support has a rear transverse face with two recesses therein, and a front transverse face. The body includes a transverse face having two projections thereon, each adapted to engage one of the recesses of the support. The recesses and projections define two lines of support converging at a point above the ski and disposed, respectively, on either side of the longitudinal plane of symmetry of the ski, so that the body can pivot along either one of the lines of support. A spring urges the rear face of a piston against the front transverse face of the support so that the rear traverse face of the support is urged against the transverse face of the body. The rear face of the piston includes two lines of reaction converging toward the ski. Because the two lines of reaction are on the rear face of the piston, the return moment of the binding increases continuously as the binding pivots further away from a central retaining position, thereby ensuring the rapid return of the binding whatever the displacement of the boot. In addition, because lines of reaction are on the rear face of the piston, the line of contact between the rear face of the piston and the support is constant.

38 Claims, 12 Drawing Figures

SAFETY BINDING FOR SKI

BACKGROUND OF THE INVENTION

The present invention relates to a safety binding for ski.

A safety binding is already known which comprises a monobloc jaw in which one end of the sole of a ski boot engages and is held, this jaw or the support of the jaw being applied, under the action of an elastic mechanism, against two lateral lines of support disposed respectively on either side of the longitudinal plane of symmetry perpendicular to the ski and converging at a point located above the ski. These two lines of support are formed on a support means fixed to the ski and extending substantially vertically inside a housing formed in the monobloc assembly constituted by the jaw and a casing of the binding. One of the opposite transverse faces of the jaw end of the support means presents recessed portions and the other presents projecting members which are housed in said recessed portions and which thus materialise the lines of support which, see in the axis of the ski, converge towards a point located above this ski. In this way, the jaw may pivot either on one of the lines of support or on the other.

In a binding of this type, the jaw or an intermediate piece is located on one side of the support means and is applied against the rear face thereof, whilst the elastic mechanism is housed on the other side of the support means, in the casing of the binding fast with the jaw. This elastic mechanism comprises a mobile member applied under pressure against the front face of the support means, under the action of an elastic member abutting on the casing, so as to apply the jaw elastically on the support means.

In a particular embodiment of such a safety binding, forming the subject matter of French Application for Certificate of Addition No. 78 08342 filed Mar. 22, 1978, the fixed support means presents, on its front face, at least two lines of reaction converging towards the ski and on which the elastically urged member is applied under pressure in the course of a movement of disconnection. The two lines of reaction are disposed so that, for a position of the binding spaced apart from the central retaining or rest position, the line of support of the monobloc assembly constituted by the jaw and the casing of the binding and the line of reaction on which the elastically urged member is applied under pressure, are located on either side of the longitudinal plane of symmetry perpendicular to the ski.

Although such a known safety binding has particularly advantageous features as far as the holding of the boot during the lateral disconnection movement is concerned, it presents the drawback that the support means, which is the element of resistance of the binding, must be moulded or machined so as to present on its front face the two convergent lines of reaction. This results in that the cost price of such a support means and consequently of the binding is relatively high. Furthermore, in the course of a lateral disconnection movement, the leverage of the effort exerted by the elastically urged member decreases regularly so that the return moment of the binding due to this effort decreases very substantially after a certain disconnection stroke. This result is that the return of the jaw of the boot into normal or rest position is difficult to effect as the return mement is relatively low.

SUMMARY OF THE INVENTION

It is essentially an object of the present invention to remedy these drawbacks by providing a safety binding of particularly simple design, enabling an energetic return into rest position to be obtained, whatever the position reached in the course of a lateral disconnection movement, before the total release of the boot.

To this end, this safety binding for ski comprising a support means fixed to the ski and extending substantially perpendicularly to this ski, an assembly constituted by a jaw fast with a casing and in which one end of the sole of a ski boot is engaged and held, this jaw-casing assembly presenting a housing inside which the support means extends and being applied, under the action of an elastic mechanism, against at least two lateral lines of support provided on the rear face of the support means, disposed respectively on either side of the longitudinal plane of symmetry of the ski and which, seen in the axis of the ski, converge at a point located above the ski, these two lines of support being materialised by recessed and projecting portions, provided on the opposite transverse faces of the jaw-casing assembly and of the support means, so that this assembly may pivot either on one of the lines of support, or on the other, the elastic mechanism comprising a mobile member applied under the pressure of a spring against the front face of the support means, is characterised in that the mobile member of the elastic mechanism presents at its rear end at least two lines of reaction converging towards the ski.

According to a further feature of the invention, each of these lines of reaction which are symmetrical with respect to the longitudinal plane of symmetry of the binding, is parallel to the corresponding line of support, provided on the support means, which is opposite it with respect to the longitudinal plane of symmetry, and for a position of the binding spaced apart from the central retaining position, the line of support of the assembly constituted by the jaw and the casing of the binding and the line of reaction by which the member of the elastic mechanism is applied under pressure on the support means, are located on either side of the longitudinal plane of symmetry of the binding.

The safety binding according to the invention offers the advantage that the support means may be made very simply, for example by means of a piece of steel plane formed with a press, its front face on which the elastically urged member slides having a geometrically simple, for example rectangular form. Furthermore, due to the provision of the lines of reaction on the elastically urged member, a progressive, regular increase is obtained of the return moment, in the course of the disconnection movement, so that the energy accumulated by the spring urging the member of the elastic mechanism ensures in any case a return of the boot and of the binding into rest or retaining position, if the release of the boot has not taken place.

Finally, another advantage offered by the invention is that the lines of reaction are of constant length, whatever the position of the member in height, since they are constituted by edges provided on the rear face of the elastic member, these edges sliding on the front face of the support means.

BRIEF DESCRIPTION OF THE DRAWINGS

The invention will be more readuly understood on reading the following description with reference to the accompanying drawings, in which.

DESCRIPTION OF THE PREFERRED EMBODIMENTS

Figure 1:
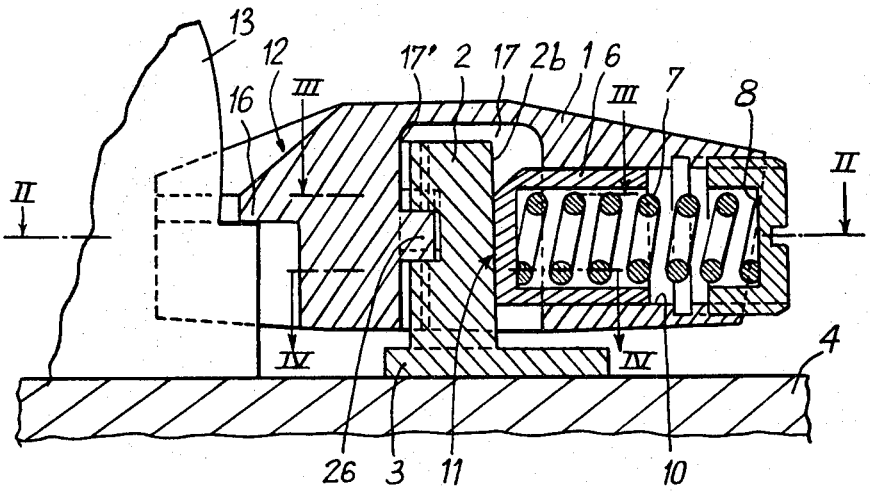
FIG. 1 is a view in vertical, axial section of a safety binding according to the invention, in rest position.

Referring now to the drawings, the safety binding according to the invention constitutes a stop for the front of a ski boot 13. It comprises a body or casing 1 which is movably mounted on a fixed piece 2 on which it is maintained elastically in abutment. This support means 2 is fast with a base plate 3 which is fixed on the top surface of a ski 4, for example by means of screws 5. The body 1 is maintained elastically in abutment on the fixed means 2 due to an elastic device comprising a piston 6 urged by a compression spring 7 and which is permanently applied under pressure by this spring against the front face **2*b* of the support means 2. The compression spring 7 which extends axially inside the body 1, abuts furthermore, at its front end, on the end 8 of an adjusting plug 9 screwed at the front of the body. The piston 6 is mounted to slide in a bore 10 disposed in the front part of the body 1**, along the longitudinal axis thereof. It should be noted that all the embodiments shown a one-piece assembly formed by a casing plus jaw but this is not necessarily the case, provided that the jaw and the casing, if they are made of a plurality of elements, are fast in displacement whenever there is a disconnection.

The piston 6 is preferably constituted by a cylindrical sleeve of revolution comprising a rear support face 11 which is applied against the front face **2*b* of the support means 2**.

A jaw 12 which is fast with the body 1 and in fact constitutes the rear part thereof, holds the front of the ski boot 13. The boot is held laterally due to the substantially vertical faces 14 and 15 of the wings of the jaw 12 and vertically due to a horizontal flange 16 of this jaw.

Figure 2:
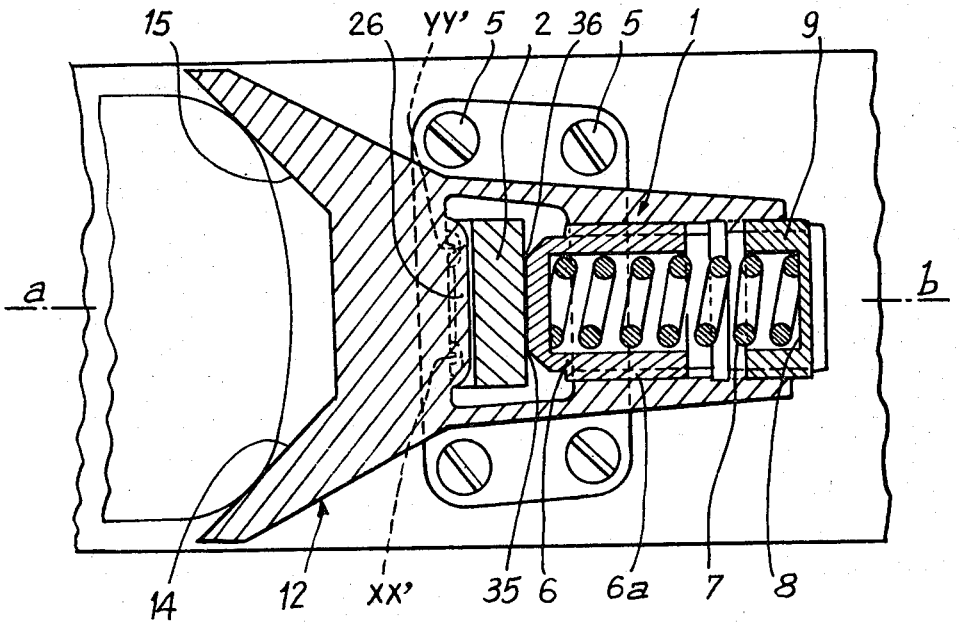
FIG. 2 is a view in horizontal section along II—II of FIG. 1.

As may be seen in FIGS. 1 and 2, the body 1 comprises a central recess 17 in which the support means is engaged. This recess 17 is substantially parallelepipedic in form and it is downwardly open, i.e. in the direction of the ski 4. The dimensions of this recess 17 are such that the body 1 may tip on both sides, as may be seen in particular in FIGS. 7 and 8.

Figure 3:
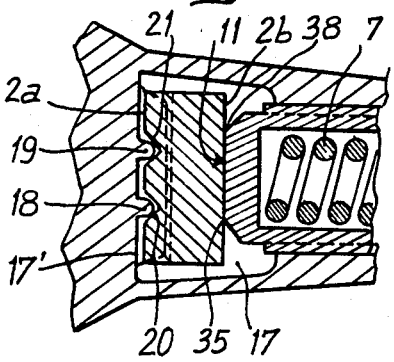
FIG. 3 is a partial view in horizontal section along III—III of FIG. 1.
Figure 4:
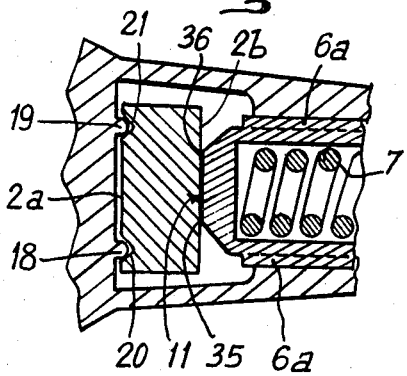
FIG. 4 is a partial view in horizontal section along IV—IV of FIG. 1.
Figure 4:
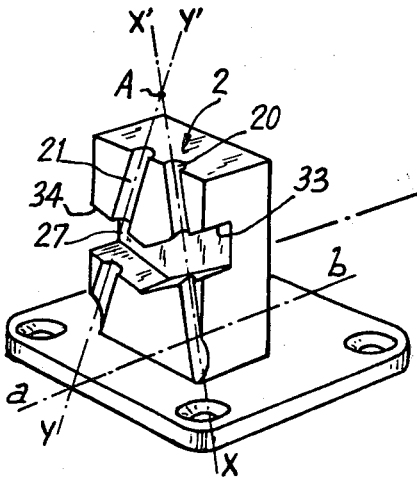

The inner, rear face 17' of the recess 17, i.e. the one located towards the jaw 12, presents two forwardly projecting sections 18 and 19 (FIGS. 3 and 4). These two projecting sections constitute two ribs which converge at a point located above the ski.

Figure 5:
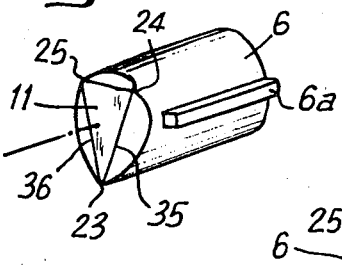
FIG. 5 is a view in perspective showing the rear faces of the support means and of the piston.

When the body 1 is in normal position of use or position of rest, the two ribs (projecting sections) 18 and 19 take their place in two corresponding grooves or recessed sections 20 and 21 provided in the rear face **2*a* of the support means 2 and which converge at a point A located above the ski (FIG. 5), point where the two ribs 18 and 19 also converge. The two ribs 18 and 19 engaged in the two grooves 20 and 21** thus define two lines of support X—X' and Y—Y' converging at point A.

A sufficient space is provided between the rear face 17' of the recess 17 and the rear face **2*a* of the support means 2 to allow the tipping movement of the ribs 18, 19**.

The body 1 is maintained in abutment on the rear face **2*a* of the support means 2 due to the elastic device which is disposed towards the front with respect to the fixed support means 2 and which comprises the piston 6 urged rearwardly by the spring 7. This piston 6 is thus permanently in elastic abutment against the front transverse face 2*b* of the support means 2**, which face is flat and rectangular in shape for example.

Figure 6:
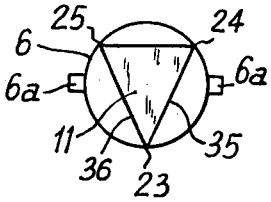
FIG. 6 is a view of the triangular rear face of the piston.

This transverse front face **2*b* is included in a plane parallel to the transverse plane defined by the lines of support X—X' and Y—Y'. On this face abuts the rear transverse face 11 of the piston 6 which has the form of an isosceles triangle or trapezium with the vertex directed downwardly (FIGS. 5, 6 and 10), and/of which the vertices are indicated by 23, 24, 25. According to the invention, the edge 35 which is included between a top vertex 24 and the bottom vertex 23 of the triangular rear face 11 is parallel to the line of support Y—Y', whilst the other edge 36, included between the other top vertex 25 and the lower vertex 23**, is parallel to the line of support X—X'.

It should be noted that the line of support X—X' and the edge 36 are located on either side of the longitudinal plane of symmetry a-b perpendicular to the ski and that the same applies to the other line of support Y—Y' and the edge 35.

The piston 6 may be mounted to rotate freely about its axis, in the bore 10. However, it is preferable if it is guided longitudinally so as always to be maintained in correct position, during its movement of longitudinal slide in the bore 10. To this end, guide members may be provided on the lateral surface of the piston 6, which cooperate with other members extending longitudinally in the bore 10. These guide members may be constituted for example by longitudinal ribs **6*a* provided on the lateral surface of the piston 6 and sliding in corresponding grooves made in the wall of the bore 10. The position of the ribs 6*a* and of the corresponding guide grooves is determined so that the two edges 35, 36 or the rear support face 11** are symmetrical with respect to a vertical and longitudinal plane.

The body 1 is retained vertically with respect to the fixed support means 2 by means of a projection 26, which extends forwardly from the rear face 17' of the recess 17, and which is engaged in a corresponding housing 27 made in the rear face 2a of the support means 2.

The projection 26 comprises, in fact, two projecting sections corresponding respectively to the ribs 18 and 19. These projecting sections extend substantially perpendicularly to the axes of the ribs 18 and 19, i.e. to the lines of support X—X' and Y—Y', so that the projection 26 is generally in the form of a V very widely open towards the top.

The projection 26 defines upper retaining flanges located in planes respectively perpendicular to the axes of the ribs 18 and 19.

The recessed section 27 made in the rear face 2a of the support means 2 and with which the projection 26 cooperates, defines two upper flanges 33 and 34 for vertical retention, the upper flange 33 being perpendicular to the line of support X—X' and the flange 34 being perpendicular to the other line of support Y—Y'.

Figure 8:
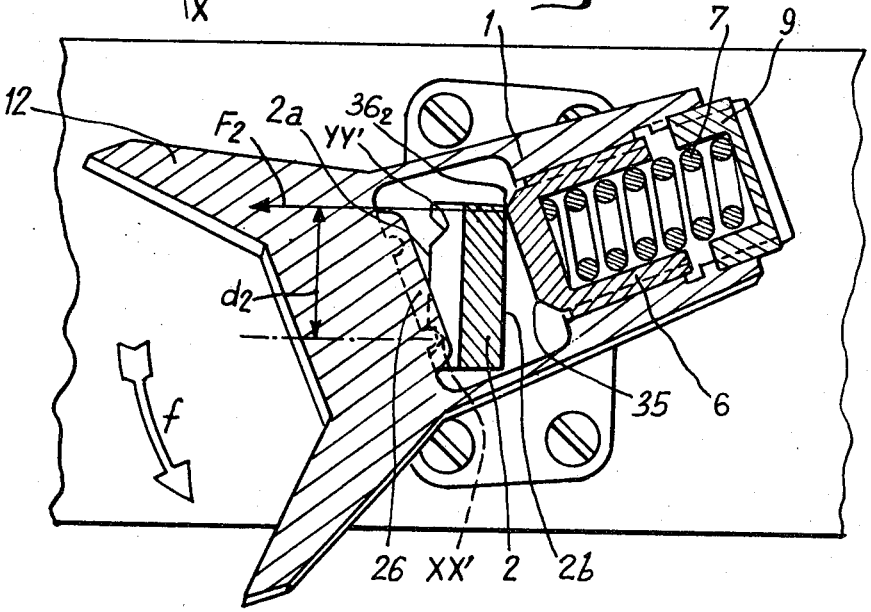
FIG. 8 is a view in horizontal section similar to that of FIG. 2, the binding being shown at the end of the lateral disconnection movement.
Figure 7:
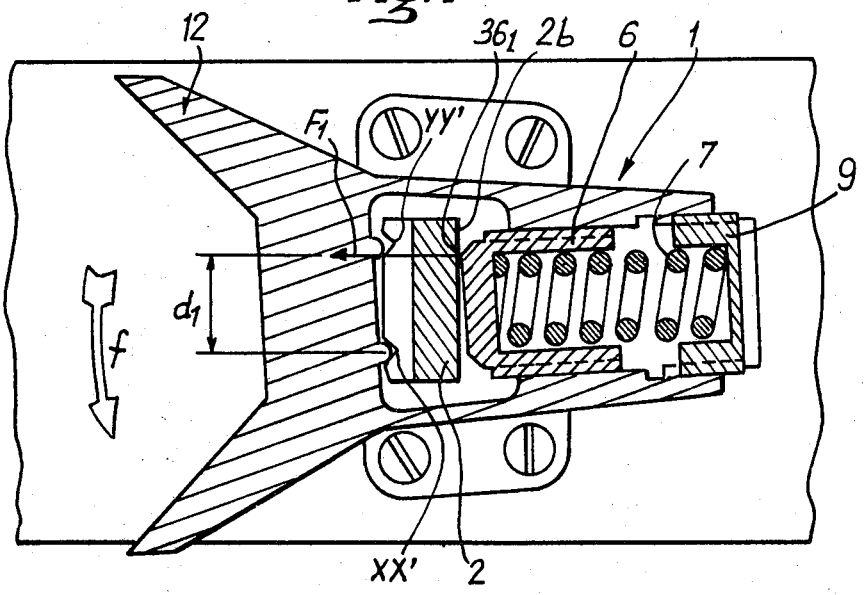
FIG. 7 is a view in horizontal section, similar to that of FIG. 2, the binding being shown at the beginning of a lateral disconnection movement.

Upon lateral disconnection, the assembly formed by the jaw 12 and casing or body 1 pivots either on one of the lines of support X—X' or on the other Y—Y', depending on the direction of disconnection. This pivoting is effected elastically against the action of the elastic device acting, by action of the piston 6, against the front face 2b of the support means 2, along a line of reaction. FIGS. 7 and 8 illustrate a lateral disconnection towards the right in the direction of arrow f (anticlockwise direction).

In the course of this movement, the assembly formed by the jaw 12 and the body 1 pivots about the line of support X—X'. In rest or starting position, the piston 6 is applied against the front face 2b of the support means 2 by its triangular rear face 11. From the beginning the tipping movement about the line of support X—X', the piston 6 pivots with respect to the support means 2 so that it bears thereon only by its edge 36 defining a line of reaction. This edge is then in the position $36_1$ indicated in FIG. 7 and in this position the piston 6 exerts on the front face 2b of the support piece 2 an effort $F_1$ perpendicular to the face 2b along an axis located at a distance $d_1$ from the line of support X—X'. The assembly formed by the jaw 12 and th body 1 is therefore subjected, in the position illustrated in FIG. 7, to a return moment, in clockwise direction, of value $F_1 \times d_1$.

When the pivoting movement corresponding to the lateral disconnection continues, the binding may reach a position as illustrated in FIG. 8 in which it is tipped further towards the outside. In this case, the edge 36 of the piston 6 is displaced further towards the outside and is in position $36_2$ on the front face 2b of the support means 2. In this position, due to the tipping movement, the piston 6 has been pushed further into the bore 10, bringing about an additional compression of the return spring 7, so that the piston 6 exerts on the support means 2 an effort $F_2$ greater than the effort $F_1$. Furthermore, the point of application of this effort is more to the outside, so that the leverage $d_2$ of the effort $F_2$ is greater than the leverage $d_1$ of the leverage $d_1$ of the effort $F_1$. This results in that the return moment of the binding $F_2 \times d_2$ when it is in the position illustrated in FIG. 8 is much greater than the moment of return $F_1 \times d_1$.

Figure 9:
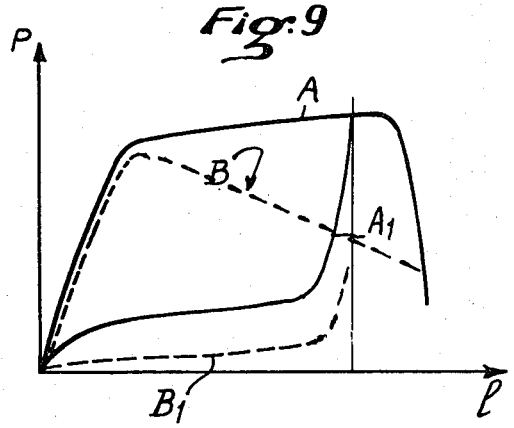
FIG. 9 is a diagram illustrating the variation of the effort exerted on the end of the boot as a function of the transverse displacement of this end, in the case of the binding according to the invention and a prior known binding.

FIG. 9 illustrates the approximate variation of the effort P before being exerted on the end of the boot as a function of the lateral displacement 1 of this end. Curve A shown in solid lines represents the variation of the effort P obtained with a binding according to the invention, during the movement of lateral disconnection, and curve $A_1$ corresponds to the variation of this effort during the return of the binding to its rest position. FIG. 9 shows in dashed lines another curve B giving the variation of the effort P in the course of the disconnection of a binding of prior known type and in which the piston 6 presents a circular rear face 11 applied against a front face $2_b$ of the support means 2 presenting a triangular form with downwardly directed vertex. Curve $B_1$ indicates the variation of the effort during the return of the known binding into rest position.

The curves of FIG. 9 show that the binding according to the invention offers the advantage that the effort exerted on the end of the boot is maintained at a high level, even for a fairly considerable lateral displacement 1, which gives much more energy for the return of the boot and of the binding into rest position than in the case of the prior known binding. In fact, the curve B shows that with a binding of this type, although the effort exerted on the end of the boot increases progressively at the beginning of the lateral disconnection, it then decreases very substantially, this being due to a notable reduction of the return moment itself provoked by a considerable reduction of the leverage. This is not the case with the binding according to the invention since, as has been seen previously, the effort exerted by the piston 6 increases as well as the leverage as the lateral disconnection movement progresses.

Figure 10:
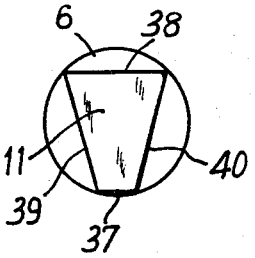
FIG. 10 is a view of a rear face of the piston in the form of an isosceles trapezium.

FIG. 10 illustrates a variant embodiment of the piston 6 in which the rear support face 11 thereof has the form of an isosceles trapezium. The small base 37 and the large base 38 of this isosceles trapezium are respectively located in the lower part and in the upper part of the support face 11 and they are connected by two edges 39 and 40 which are symmetrical with respect to the vertical and longitudinal plane and constituting lines of reaction coming into contact with the front face 2b of the support means 2 in the course of the lateral disconnection movement.

Figure 11:
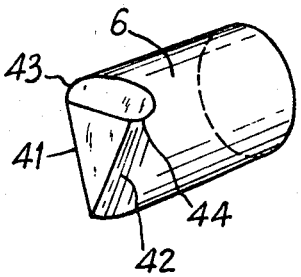
FIG. 11 is a view in perspective of a variant embodiment of the piston.
Figure 12:
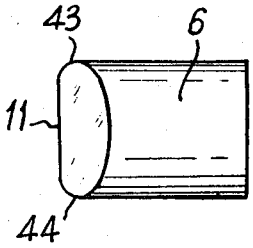
FIG. 12 is a plan view of the piston illustrated in FIG. 11.

FIGS. 11 and 12 show another variant embodiment of the piston 6. In the embodiments which have been described hereinabove, the edges 35, 36 (FIG. 6) or 39, 40 (FIG. 10) of the piston 6 are fixed with respect to this piston but they constitute with respect to the front face 2b of the support means 2 lines of reaction which move over this front face $2_b$ in the course of a lateral disconnection movement.

In the variant embodiment illustrated in FIGS. 11 and 12, the lines of reaction in the course of a movement of disconnection move over the piston 6. To this end, this piston 6 has two reaction surfaces 41 and 42 which are symmetrical with respect to the vertical and longitudinal plane of symmetry.

These reaction surfaces 41 and 42 connect the flat rear transverse face 11, in the form of an isosceles triangle or trapezium with vertex or small base directed downwardly, and the cylindrical lateral surface of the piston 6.

The reaction surface 41 is a cylindrical surface which is produced by a line of reaction moving over a curve 43, whilst remaining parallel to the line of support X—X'. In the same way, the reaction surface 42 is also a cylindrical surface produced by a line of reaction moving over a curve 44 whilst remaining parallel to the line of support Y—Y'. With such an arrangement, in the course of a disconnection, the piston 6 is in abutment on the front face 2*b* of the support means 2 along a line of reaction, constituting a generatrix of the cylindrical surfaces 41 and 42, this line of reaction moving, in the course of the movement of disconnection, over the cylindrical surface 41 or 42 whilst always remaining parallel to the corresponding line of support X—X' or Y—Y'.

In a binding of this type, it should be noted that the lines of reaction which are constituted by the edges 35, 36 or 39, 40 or by generatrices of the surfaces of reaction 41, 42 have a constant length used whatever the height of the piston with respect to the plane of the ski.

In other words, the piston 6 is applied on the flat front face 2*b* of the support means 2, always along a section of straight line of invariable length whatever the adjustment of the binding in height. This constitutes a noteworthy advantage with respect to the known binding in which the converging lines of reaction are fixed on the support means. In this latter case, the length of the portion of reaction line formed on the fixed support means decreases as the piston moves vertically.

It should be noted that the features of the invention may be used in a binding of the type such as the one described in French patent application No. 79 14484 of June 6, 1979 and in which the upper support is effected on a screw for adjustment in height, moving the assembly constituted by the jaw and the casing with respect to the support means.

The fact of making the support means of a plurality of independent elements would, or course, not depart from the scope of the invention. For example, the support means may comprise a front element fixed to the ski and comprising the support face for the piston, and another independent outer element also fixed to the ski and comprising the lines of support. It should also be noted that the lines of support are at least two in number, but this is not necessarily the case, as is described in French patent application No. 78 08342 of Mar. 22, 1978.

What is claimed is:

1. A safety binding for a ski, comprising:

(a) a support means adapted to be fixed to said ski, having a rear transverse face with at least two recesses therein and a front transverse face;

(b) a body comprising:

(i) a holding means adapted to hold a ski boot;

(ii) a transverse face on said body, having at least two projections thereon, each projection adapted to engage one of said recesses, wherein said recesses and projections define two lines of support converging at a point above said ski and disposed respectively, on either side of the longitudinal plane of symmetry of said ski, so that said body may pivot around either one of said lines of support; and (iii) an abutting means for causing said transverse face of said body to abut said rear face of said support, wherein said abutting means includes a rear face which abuts said front transverse face of said support and which includes two lines of reaction converging toward said ski.

2. The safety binding of claim 1 wherein said support means extends substantially perpendicular to said ski.

3. The safety binding of claim 1 wherein said holding means includes a jaw fast with said body for engaging one end of the sole of a ski boot.

4. The safety binding of claim 1 wherein said body includes a recess therein adapted to receive said support means.

5. The safety binding of claim 4 wherein said recess is parallelepipedic in shape.

6. The safety binding of claim 1 wherein said abutting means includes:

(a) a mobile member having said rear face thereon; and (b) a pressure means adapted to urge said rear face of said mobile member against said front transverse face of said support.

7. The safety binding of claim 6 wherein said mobile member is a piston and said pressure means is a spring.

8. The safety binding of claim 1 wherein said reaction lines are disposed, respectively, on either side of the longitudinal plane of symmetry of said ski, and each of said reaction lines are parallel to a line of support on the opposite side of the longitudinal plane of symmetry.

9. The safety binding of claim 8 wherein said binding is adapted to move from a central retaining position to a position spaced from said central retaining position, wherein the line of support and the line of reaction associated with said position spaced apart from said central position are located respectively, on opposite sides of the longitudinal plane of symmetry of said ski.

10. The safety binding of claim 1 wherein said rear face of said abutting means is in the shape of an isosceles triangle having a lower vertex directed toward said ski, and having two upper vertices, wherein the two sides of said rear face which extend between the lower and upper vertices are symmetrical with respect to a vertical and longitudinal plane of symmetry, and comprise reaction edges.

11. The safety binding of claim 1 wherein said abutting means is adapted to elastically urge said support means against said body.

12. The safety binding of claim 1 wherein said rear face of said abutting means is in the shape of an isosceles trapezium having a small base and large base located, respectively, at the bottom and top of said rear face, and connected by two reaction edges which are symmetrical with respect to a vertical and longitudinal plane of symmetry.

13. The safety binding of claim 1 wherein said rear face of said abutting means includes two lateral cylindrical surfaces of reaction, symmetrical with respect to vertical and longitudinal planes of symmetry of said binding.

14. The safety binding of claim 8 wherein said rear face of said abutting member includes two lateral cylindrical surfaces of reaction, symmetrical with respect to vertical and longitudinal planes of symmetry of said binding.

15. The safety binding of claim 10 wherein said rear face of said abutting means includes two lateral cylindrical surfaces of reaction, symmetrical with respect to vertical and longitudinal planes of symmetry of said binding.

16. The safety binding of claim 12 wherein said rear face of said abutting means includes two lateral cylindrical surfaces of reaction, symmetrical with respect to vertical and longitudinal planes of symmetry of said binding.

17. The safety binding of claim 13 wherein said reaction surfaces are the product of the moving of a straight line of reaction along a curve and parallel to a support line on the other side of the longitudinal plane of symmetry of said ski.

18. The safety binding of claim 13, wherein said rear face of said abutting means moves over said front face of said support means in a line of reaction over one of said cylindrical surfaces and parallel to a line of support on the other side of said longitudinal plane of said ski as said binding pivots about one of said lines of support.

19. The safety binding of claim 1 wherein said abutting means includes a bore and a piston which reciprocates therein, wherein said piston is adapted to rotate freely about its longitudinal axis in said bore.

20. The safety binding of claim 8, wherein said abutting means includes a bore and a piston which reciprocates therein, wherein said piston is adapted to rotate freely about its longitudinal axis in said bore.

21. The safety binding of claim 10, wherein said abutting means includes a bore and a piston which reciprocates therein, wherein said piston is adapted to rotate freely about its longitudinal axis in said bore.

22. The safety binding of claim 12, wherein said abutting means includes a bore and a piston which reciprocates therein, wherein said piston is adapted to rotate freely about its longitudinal axis in said bore.

23. The safety binding of claim 13, wherein said abutting means includes a bore and a piston adapted to reciprocate therein, wherein said piston is adapted to rotate freely about its longitudinal axis in said bore.

24. The safety binding of claim 1, wherein said abutting means includes stop means to prevent said abutting means from rotating about its longitudinal axis.

25. The safety binding of claim 8, wherein said abutting means includes stop means to prevent said urging means from rotating about its longitudinal axis.

26. The safety binding of claim 10, wherein said abutting means includes stop means to prevent said abutting means from rotating about its longitudinal axis.

27. The safety binding of claim 12, wherein said abutting means includes stop means to prevent said abutting means from rotating about its longitudinal axis.

28. The safety binding of claim 13, wherein said abutting means includes stop means to prevent said abutting means from rotating about its longitudinal axis.

29. An elastic member for a ski binding with at least two projections thereon, each of which is adapted to engage a recess on the rear face of support on a ski wherein the support also has a front face and the recesses and projections define two lines of support converging at a point above the ski and disposed, respectively, on either side of the longitudinal plane of symmetry of the ski, comprising:

(a) a piston having a rear face thereon comprising two lines of reaction converging toward the ski.

(b) an elastic means adapted to urge said piston against the front face of the support.

30. The elastic member of claim 29 wherein said reaction lines are disposed, respectively, on either side of the longitudinal plane of symmetry of said ski, and each of said reaction lines are parallel to a line of support on the opposite side of the longitudinal plane of symmetry.

31. The elastic member of claim 29 wherein said rear face of said piston is in the shape of an isosceles triangle having a lower vertex directed toward said ski, and having two upper vertices, wherein the two sides of said rear face which extend between the lower and upper vertices are symmetrical with respect to a vertical and longitudinal plane of symmetry, and comprise reaction edges.

32. The elastic member of claim 29 wherein said rear face of said piston is in the shape of an isosceles trapezium having a small base and large base located, respectively, at the bottom and top of said rear face, and connected by two reaction edges which are symmetrical with respect to a vertical and longitudinal plane of symmetry.

33. The elastic member of claim 29 wherein said rear face of said piston includes two lateral cylindrical surfaces of reaction, symmetrical with respect to vertical and longitudinal planes of symmetry of said binding.

34. The elastic member of claim 30 wherein said rear face of said urging member includes two lateral cylindrical surfaces of reaction, symmetrical with respect to vertical and longitudinal planes of symmetry of said binding.

35. The elastic member of claim 31 wherein said rear face of said piston includes two lateral cylindrical surfaces of reaction, symmetrical with respect to vertical and longitudinal planes of symmetry of said binding.

36. The elastic member of claim 32 wherein said rear face of said piston includes two lateral cylindrical surfaces of reaction, symmetrical with respect to vertical and longitudinal planes of symmetry of said binding.

37. The elastic member of claim 33 wherein said reaction surfaces are the product of the moving of a straight line of reaction along a curve and parallel to a support line on the other side of the longitudinal plane of symmetry of said ski.

38. The elastic member of claim 33 wherein said rear face of said piston moves over said front face of said support means in a line of reaction over one of said cylindrical surfaces and parallel to a line of support on the other side of said longitudinal plane of said ski as said binding pivots about one of said lines of support.

* * * * *